US005379813A

United States Patent [19]

Ing

[11] Patent Number: 5,379,813

[45] Date of Patent: Jan. 10, 1995

[54] LIQUID DISPENSER

[76] Inventor: Hwang L. C. Ing, P.O. Box 1750, Taichung, Taiwan, Prov. of China

[21] Appl. No.: 118,618

[22] Filed: Sep. 10, 1993

[51] Int. Cl.[6] ..... B65B 3/00

[52] U.S. Cl. ..... 141/351; 141/18; 141/320; 141/353; 141/364; 222/181

[58] Field of Search ..... 141/2, 18, 21, 22, 319-321, 141/351, 353, 354, 356, 360, 346, 363-366; 220/288; 215/315, 329; 62/389, 391; 222/181

[56] References Cited

U.S. PATENT DOCUMENTS

| | | | |
|---|---|---|---|
| 604,366 | 5/1898 | Campbell | 141/351 |
| 1,018,924 | 2/1912 | Patnaude | 141/364 X |
| 1,399,240 | 12/1921 | Bagley et al. | 141/351 |
| 2,489,746 | 11/1949 | Buneta | 141/351 |
| 2,721,450 | 10/1955 | Entler | 62/389 |
| 4,991,635 | 2/1991 | Ulm | 141/346 |
| 5,174,476 | 12/1992 | Steiner et al. | 222/181 |
| 5,222,531 | 6/1993 | Baker et al. | 141/18 |

*Primary Examiner*—J. Casimer Jacyna

[57] ABSTRACT

A liquid dispenser comprises a liquid container, a cover body, a control pin, a bottom seat, a hose, and a valve. The cover body is fastened to the bottom portion of the liquid container and provided with a protruded seat with a permeating hole. The control pin is encased in a coil spring and received in the permeating hole. The control pin is provided at an upper end thereof with a water-checking washer. The bottom seat is provided with a receiving space dimensioned to receive therein the cover body. The bottom portion of the bottom seat is provided with a through hole and a connection tube to which the hose is attached. The receiving space is provided with a support rod capable of pushing the control pin to move upwards, thereby permitting the liquid held in the container to be dispensed via the receiving space, the hose and the valve.

1 Claim, 4 Drawing Sheets

LIQUID DISPENSER

BACKGROUND OF THE INVENTION

The present invention relates generally to a container, and more particularly to a liquid container provided with means for filling the container and dispensing the liquid held in the container.

As the human civilization advances, the human demand for the products increases proportionally. In order to meet the human demand, the makers of the consumer goods strive to improve the quality of the products they manufacture. In addition to the quality of products, the makers of consumer goods also work hard to make sure that the goods they make are as practical and versatile as possible. A household liquid container is a case in point. However, the household liquid container in existence today is defective in design in that it is not provided with means for filling the container with the liquid and for dispensing the liquid held in the container. As a result, a user of such conventional liquid container is often bound to mess up the place in the process of filling or pouring the container. For industrial application, a liquid is often held in a bulky container. It is conceivably difficult and inconvenient or even dangerous for a worker to pour the liquid into a smaller container.

SUMMARY OF THE INVENTION

It is therefore the primary objective of the present invention to provide a liquid container with means for filling the container with a liquid and for dispensing the liquid held in the container.

In keeping with the principles of the present invention, the foregoing objective of the present invention is attained by a liquid container which has a bottom provided circumferentially with outer threads. The bottom is further provided with an opening having a bottom portion provided with a cover body which is in turn furnished with inner threads located on the inner edge thereof. The cover body is further provided centrally with a protruded seat. Located between the protruded seat and the inner edge of the cover body is a groove so dimensioned as to receive therein a leakproof washer. The body is provided centrally with a permeating hole dimensioned to fit over a control pin which is fitted into a coil spring and has an upper end with a water-checking washer attached thereto. The liquid container is mounted on a bottom seat such that a receiving space is formed in the bottom seat. The bottom seat is provided centrally with a support rod which is disposed upwardly and uprightly. The bottom seat is further provided in the bottom portion thereof with a through hole. Attached to the outer wall of the bottom portion of the bottom seat is a connection tube which is corresponding in location to the through hole and dimensioned to fit into a water-supplying hose which is in turn connected at the front end thereof with a water valve. The bottom seat is still further provided in one side thereof with an indentation. The control pin can be caused by the support rod to move upwards so as to permit the liquid held in the liquid container to flow into the receiving space from which the liquid can be then dispensed via the water valve.

The foregoing objective, structures and functions of the present invention can be more readily understood upon a thoughtful deliberation of the following detailed description of the present invention in conjunction with the accompanying drawings.

DETAILED DESCRIPTION OF THE INVENTION

Figure 1:
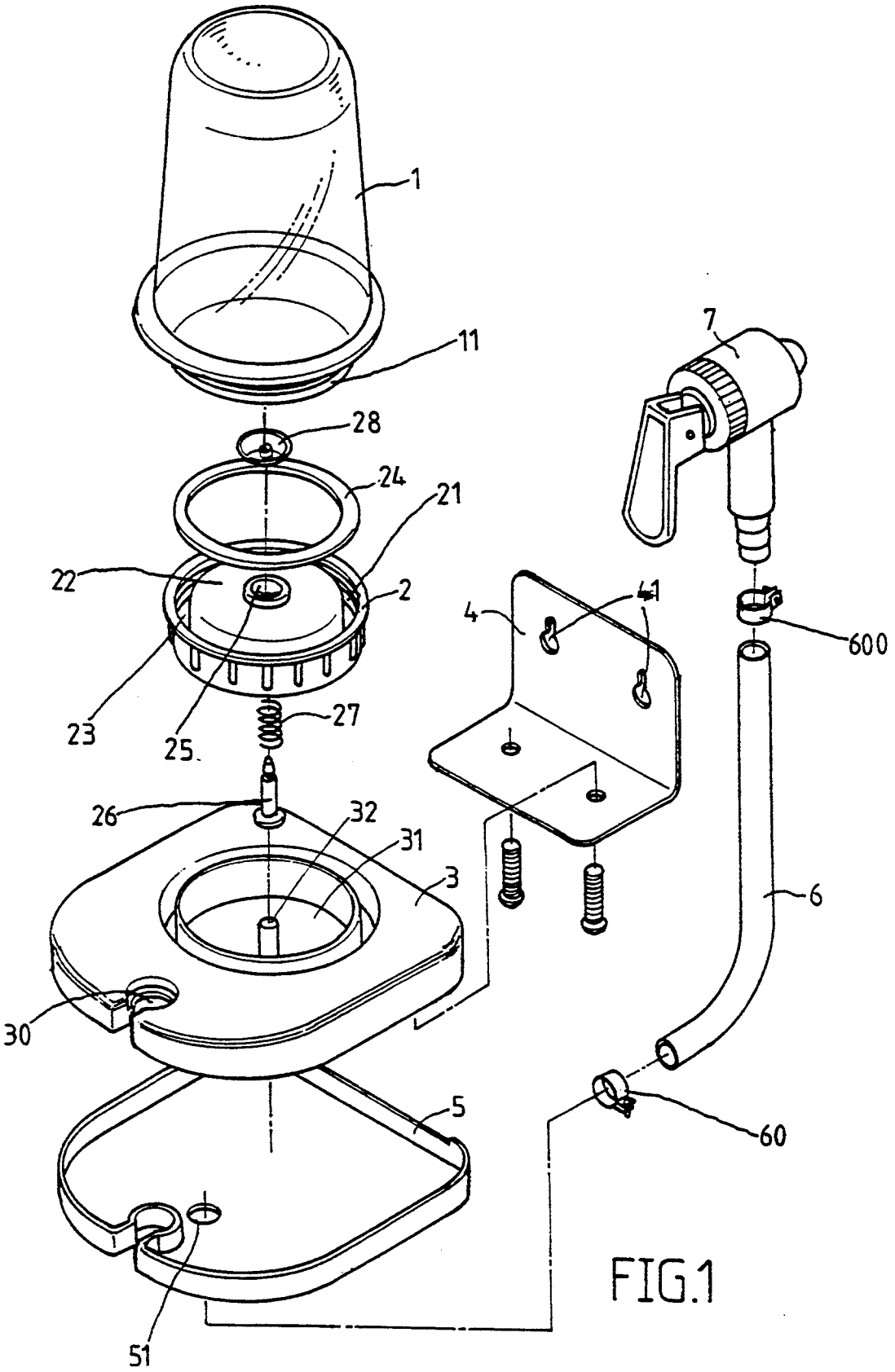
FIG. 1 shows an exploded view of a first preferred embodiment of the present invention.
Figure 2:
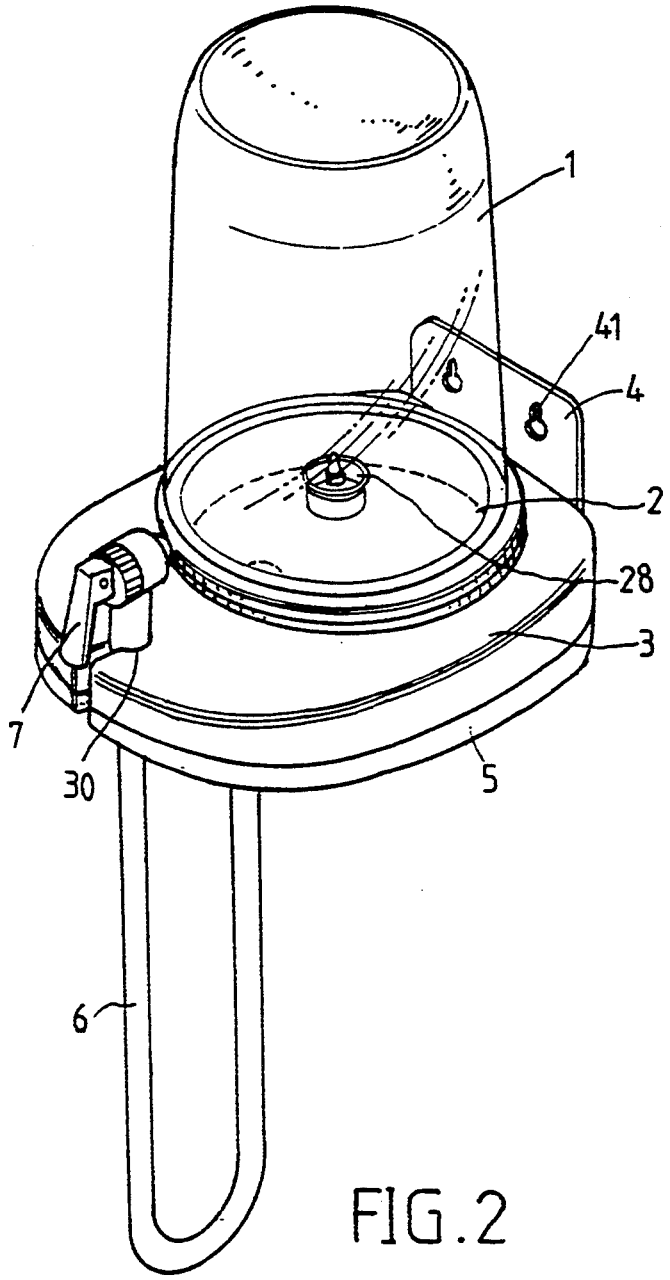
FIG. 2 shows a perspective view of the first preferred embodiment of the present invention in combination.
Figure 3:
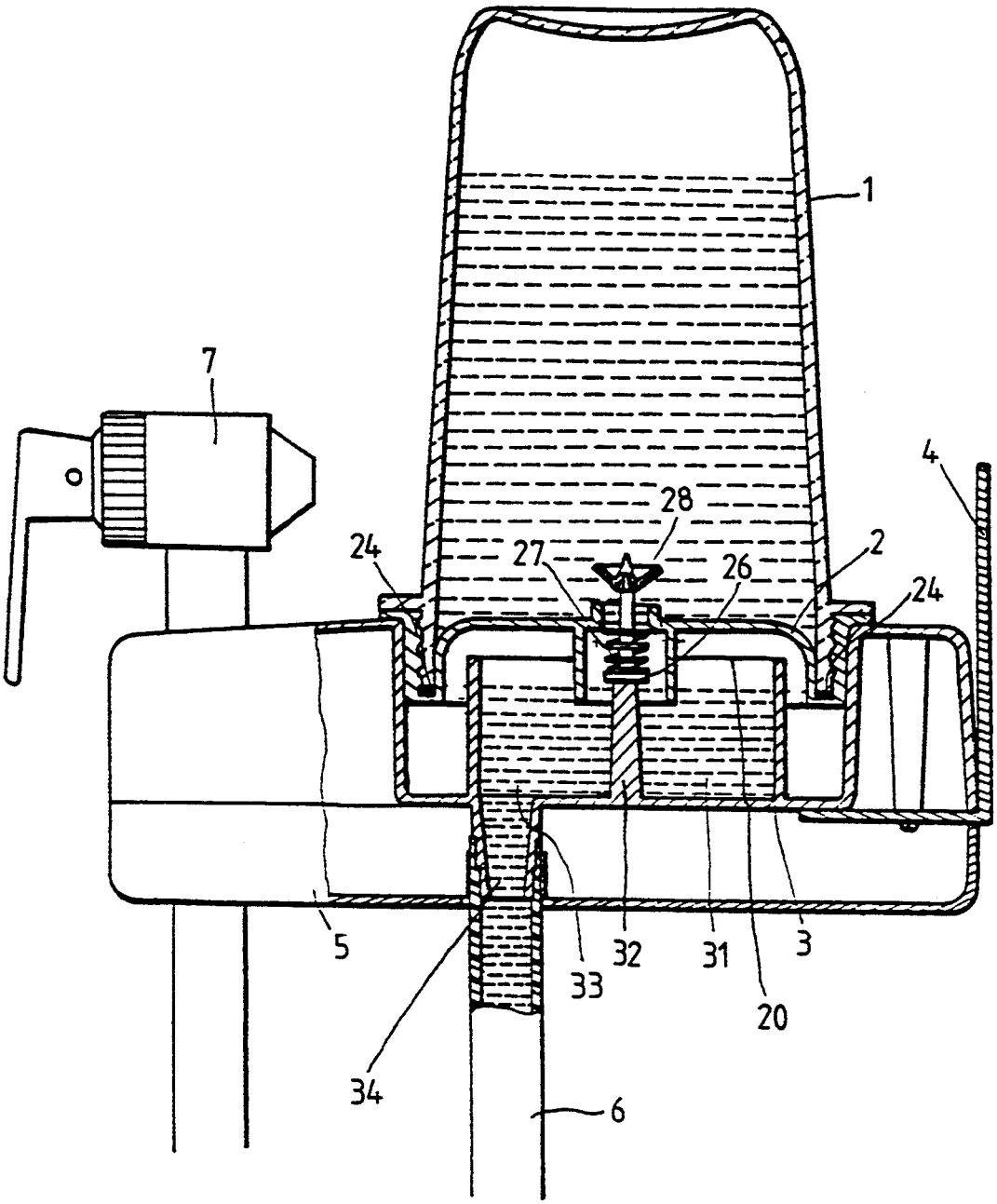
FIG. 3 shows a sectional view of the first preferred embodiment of the present invention in combination.

Referring to FIGS. 1–3, the first preferred embodiment of the present invention is shown to comprise mainly a liquid container 1 having a bottom with an opening which is provided on the outer edge thereof with outer threads 11 engageable with inner threads 21 of a cover body 2. Located centrally in the cover body 2 is a protruded seat 22, which is provided circumferential with a groove 23 dimensioned to receive therein a leakproof washer 24. Located at the center of the cover body 2 is a permeating hole 25 dimensioned to fit over a control pin 26 encased by a coil spring 27. The control pin 26 has a wide bottom and a pointed top with a water-checking washer 28 attached thereto.

The bottom portion of the cover body 2 is mounted on a bottom seat 3 such that a receiving space 31 is formed in the bottom seat 3. The bottom seat 3 is provided centrally with a support rod 32 and in the bottom portion thereof with a through hole 33. Attached to the outer wall of the bottom portion of the through hole 33 is a connection tube 34 of a predetermined length. The bottom seat 3 is further provided with a hanging plate 4 attached to the underside thereof. The hanging plate 4 is provided with two threaded holes 41. The bottom protion of the bottom seat 3 is fitted into a bottom casing 5 having a hole 51 which is corresponding in location to the through hole 33 of the bottom seat 3.

The outer surface of the connection tube 34 is so grooved as to ensure that it can hold securely a hose 6 which is fitted at the rear end thereof over the connection tube 34. The fastening of the hose 6 with the connection tube 34 can be further enhanced by means of a fastening ring 60, as shown in FIG. 1. The front end of the hose 6 is fastened to a water valve 7 by means of a fastening ring 600, as shown in FIG. 1. In combination, the cover body 2 is fastened to the container 1 by means of the inner threads 21 which engages the outer threads 11 of the container 1. In the meantime, the control pin 26, which is encased by the coil spring 27, is fitted into the permeating hole 25 of the cover body 2. The water-checking washer 28 is attached to the top end of the control pin 26 which is movably received in the permeating hole 25. The cover body 2 is attached to the container 1 by means of the inner threads 21 which engages the outer threads 11 of the container 1. The cover body 2 is mounted in the container 1. The cover body 2 is mounted in the receiving space 31 of the bottom seat 3. The hanging plate 4 is fastened to the underside of the bottom seat 3. The bottom portion of the bottom seat 3 is so dimensioned as to fit into the bottom casing 5. The hose 6 is attached at one end thereof to the connection tube 34 and at another end thereof to the water valve 7, which can be conveniently held in place in the indentation 30 of the bottom seat 3, as shown in FIG. 2.

The operation of the present invention is illustrated in FIG. 3. The cover body 2 can be opened to allow the container 1 to be filled with the liquid. After the container 1 is filled with the liquid, the cover body 2 is then mounted on the bottom seat 3, thereby causing the control pin 26 of the cover body 2 to make contact with the support rod 32 of the bottom seat 3. In other word, the control pin 26 is pushed upwards by the support rod 32 so that the water-checking washer 28 is forced to move upwards to unseal the permeating hole 25. As a result, the liquid held in the container 1 is permitted to flow into the receiving space 31 of the bottom seat 3. The liquid contained in the receiving space 31 of the bottom seat 3 is ready to be tapped.

As the valve 7 is opened to tap the liquid contained in the receiving space 31, the level of the liquid contained in the receiving space 31 drops gradually. As soon as the liquid level in the receiving space 31 becomes lower than the bottom portion of the permeating hole 25 of the cover body 2, the liquid held in the container 1 begins flowing downwards so as to replenish the receiving space 31 with the liquid until such time when the liquid level in the receiving space 31 rises to exceed the bottom portion of the permeating hole 25 of the cover body 2. The present invention is provided with the hanging plate 4 by means of which the present invention can be fastened to the wall. When the valve 7 is not in use, it can be kept in place in the indentation 30 of the bottom seat 3. The cover body 2 is provided therein with a baffle 20, which serves to prevent the liquid from making contact with the cover body 2. As a result, when a user of the present invention opens the cover body 2, his or her fingers remain unstained with the liquid. The body of the bottom seat 3 may be provided with one or more threaded holes by means of which the bottom seat 3 can be fastened to a wall.

Figure 4:
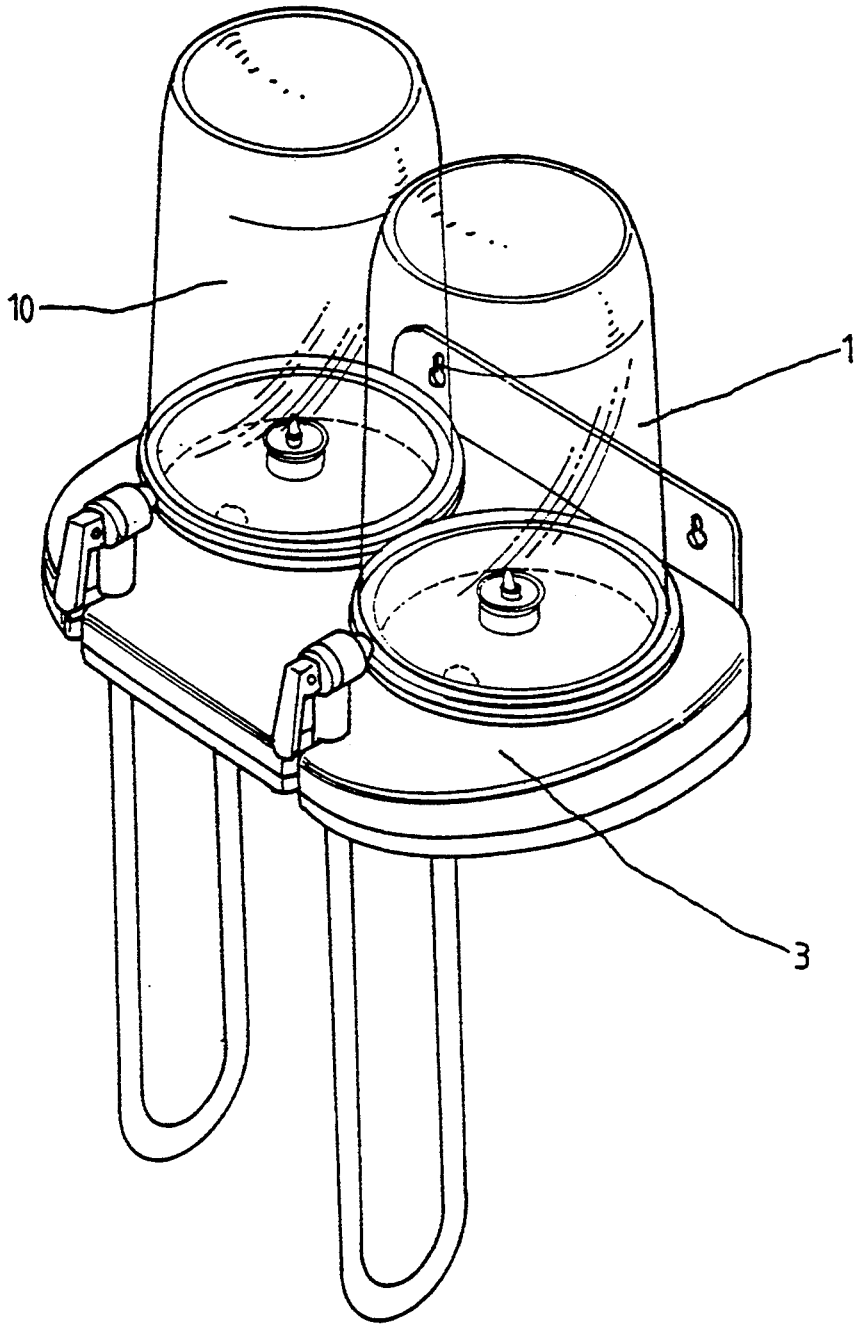
FIG. 4 shows a perspective view of a second preferred embodiment of the present invention.

As shown in FIG. 4, the second preferred embodiment of the present invention comprises two containers 1 and 10 for use in dispensing two different kinds of the liquid. The second embodiment of the present invention can be also fastened to a wall.

The advantages inherent in the present invention are described hereinafter.

The liquid held in a large container can not be dispensed easily. The job of dispensing the liquid can be done easily and conveniently by means of the liquid dispenser of the present invention.

The liquid dispenser of the present invention is provided with a hose and a valve, which make the dispensing of the liquid more accessible.

The liquid dispenser of the present invention can be fastened to a wall so as to maximize the space utilization.

The liquid dispenser of the present invention can be provided with a plurality of containers for dispensing different kinds of the liquid.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A liquid dispenser comprising:

a liquid container provided at a bottom portion thereof with outer threads;

a cover body provided on an inner edge thereof with inner threads engageable with said outer threads of said liquid container such that said liquid container is fastened securely onto said cover body which is further provided with a protruded seat having centrally a permeating hole and having peripherally a circular groove dimensioned to receive therein securely a leakproof washer;

a control pin encased in a coil spring and received movable in said permeating hole of said cover body, said control pin having a wide bottom and a pointed top with a water-checking washer attached thereto securely;

a bottom seat provided centrally with a receiving space dimensioned to receive therein said cover body and said bottom portion of said liquid container, said bottom seat further provided with a support rod for actuating said control pin and said water-checking washer, said bottom seat still further provided in a bottom portion thereof with a through hole through which liquid contained in said receiving space of said bottom seat is dispensed via a connection tube which is fastened at one end thereof with a bottom wall of said through hole;

a hanging plate attached securely to one side of an underside of said bottom seat for fastening said bottom seat to a wall;

a bottom casing dimensioned to hold securely therein said bottom portion of said bottom seat and provided with a through hole corresponding in location to said through hole of said bottom seat;

a liquid tapping hose fastened at one end thereof with another end of said connection tube; and a valve fastened securely to another end of said hose for regulating the dispensing flow of said liquid contained in said receiving space of said bottom seat having an indentation of a predetermined shape and a predetermined dimension for holding said valve when said valve is not in use.

* * * * *